US010734733B2

(12) United States Patent
Howard et al.

(10) Patent No.: US 10,734,733 B2
(45) Date of Patent: Aug. 4, 2020

(54) RANDOM, SEQUENTIAL, OR SIMULTANEOUS MULTI-BEAM CIRCULAR ANTENNA ARRAY AND BEAM FORMING NETWORKS WITH UP TO 360° COVERAGE

(71) Applicant: John Howard, Upper Mount Bethel, PA (US)

(72) Inventors: John Howard, Upper Mount Bethel, PA (US); Chuck Wah Fung, Mountain Lakes, NJ (US)

(73) Assignee: John Howard, Upper Mount, PA (US)

( * ) Notice: Subject to any disclaimer, the term of this patent is extended or adjusted under 35 U.S.C. 154(b) by 65 days.

(21) Appl. No.: 14/227,634

(22) Filed: Mar. 27, 2014

(65) Prior Publication Data

US 2015/0070241 A1 Mar. 12, 2015

Related U.S. Application Data

(60) Provisional application No. 61/874,407, filed on Sep. 6, 2013.

(51) Int. Cl.
*H01Q 21/00* (2006.01)
*H01Q 3/40* (2006.01)
(Continued)

(52) U.S. Cl.
CPC ..... *H01Q 21/0006* (2013.01); *H01Q 3/242* (2013.01); *H01Q 3/26* (2013.01); *H01Q 3/40* (2013.01); *H01Q 21/205* (2013.01)

(58) Field of Classification Search
CPC ..... H01Q 3/242; H01Q 21/0006; H01Q 3/40; H01Q 3/26; H01Q 21/205
(Continued)

(56) References Cited

U.S. PATENT DOCUMENTS 3,736,592 A * 5/1973 Coleman ..... H01Q 3/2647 342/370
3,906,502 A * 9/1975 Connolly ..... H01Q 3/34 342/372
(Continued)

FOREIGN PATENT DOCUMENTS

EP 2 846 401 A1 3/2015
WO 2005122328 A2 12/2005

OTHER PUBLICATIONS

Ireland et al. "Dielectric Embedded Multi-Beam Adaptive Array Antenna, Journal of the Japan Society of Applied Electromagnetics and Mechanics, vol. 15, Supplement (2007)".*
(Continued)

*Primary Examiner* — Daniel Munoz
*Assistant Examiner* — Bamidele A Jegede
(74) *Attorney, Agent, or Firm* — FisherBroyles, LLP

(57) ABSTRACT

An antenna array system provides simultaneous 360° coverage and includes Butler matrix beam forming networks connected to an antenna array, which includes narrow and/or broadband elements, and multiple transmitters, receivers, or transceivers to allow for 360° transmission and/or reception. The antenna array system can provide multiple beams, such as without limitation 8 or 16 beams, which can vary in beam crossing and/or overlap to provide simultaneous 360° coverage. An antenna array system includes a plurality of antenna elements configured in an array, a first Butler matrix operatively coupled to the plurality of antenna elements, and a second Butler matrix operatively coupled to the first Butler matrix. A method of providing simultaneous 360° coverage includes configuring a plurality of antenna elements in an array, coupling a first Butler matrix operatively to the plurality of antenna elements, and coupling a second Butler matrix operatively to the first Butler matrix.

9 Claims, 4 Drawing Sheets

(51) Int. Cl.
*H01Q 3/24* (2006.01)
*H01Q 3/26* (2006.01)
*H01Q 21/20* (2006.01)

(58) Field of Classification Search
USPC ..... 343/853
See application file for complete search history.

(56) References Cited

U.S. PATENT DOCUMENTS 4,652,879 A * 3/1987 Rudish ..... G01S 7/021 342/371
4,980,692 A * 12/1990 Rudish ..... H01Q 3/40 343/700 MS
5,151,706 A * 9/1992 Roederer ..... H01Q 3/40 342/372
5,179,386 A * 1/1993 Rudish ..... G01S 7/021 342/371
5,325,101 A * 6/1994 Rudish ..... H01Q 3/22 342/372
5,430,453 A * 7/1995 Rudish ..... G01S 7/021 342/373
5,610,617 A * 3/1997 Gans ..... H01Q 3/24 342/148
5,929,804 A * 7/1999 Jones ..... H01Q 3/40 342/354
6,791,507 B2 * 9/2004 Johansson ..... H01Q 1/246 343/754
6,864,853 B2 * 3/2005 Judd ..... H01Q 1/007 343/700 MS
6,992,621 B2 * 1/2006 Casas ..... H01Q 1/246 342/373
6,992,622 B1 * 1/2006 Chiang ..... H01Q 3/40 342/373
6,995,730 B2 * 2/2006 Pleva ..... H01Q 3/24 343/853
7,248,215 B2 * 7/2007 Pleva ..... H01Q 1/3283 342/154
7,567,213 B2 * 7/2009 Liu ..... H01Q 1/007 342/373
8,604,989 B1 * 12/2013 Olsen ..... H01Q 25/008 343/700 MS
2003/0098814 A1 * 5/2003 Keller, III ..... H01Q 1/243 343/742
2004/0160374 A1 * 8/2004 Johansson ..... H01Q 1/246 343/757
2005/0259005 A1 * 11/2005 Chiang ..... H01Q 3/24 342/373
2010/0066590 A1 * 3/2010 Brown ..... G01S 7/03 342/147

OTHER PUBLICATIONS

Panduro et al. "Simplifying the Feeding Network for Multi-Beam Circular Antenna Arrays by Using Corps, Progress in Electromagnetics Research Letters, vol. 21, 119-128, 2011".*
Bhowmik et al. "Optimum Design of a 4×4 Planar Butler Matrix Array for WLAN Application, Journal of Telecommunications, vol. 2, Issue 1, Apr. 2010".*
Cetinoneri et al. "An 8×8 Butler Matrix in 0.13-um CMOS for 5-6-GHz Multibeam Applications, IEEE Transactions on Microwave Theory and Techniques, vol. 59, No. 2, Feb. 2011".*
European Search Report for corresponding European Application No. EP14172161, dated Jan. 19, 2015.
Office Action for corresponding Application No. 14172161.3, 11 pages, dated Aug. 21, 2017.
Communication pursuant to Article 94(3) EPC received for EP Patent Application Serial No. 14172161.3 dated Feb. 24, 2016, 7 page.
Communication pursuant to Article 94(3) EPC received for EP Patent Application Serial No. 14172161.3 dated Oct. 6, 2016, 8 page.

* cited by examiner

RANDOM, SEQUENTIAL, OR SIMULTANEOUS MULTI-BEAM CIRCULAR ANTENNA ARRAY AND BEAM FORMING NETWORKS WITH UP TO 360° COVERAGE

CROSS-REFERENCE TO RELATED APPLICATION

This application claims the benefit of U.S. Provisional Application No. 61/874,407, filed Sep. 6, 2013, the disclosure of which is incorporated herein by reference in its entirety.

BACKGROUND

Field

Embodiments of the invention generally relate to antennas and, more particularly, relate to random, sequential or simultaneous multi-beam with up to 360° antenna coverage using a circular array and beam forming networks.

SUMMARY OF THE INVENTION

In accordance with one embodiment, an antenna array system that provides simultaneous with up to 360° coverage is disclosed, which includes Butler matrix beam forming networks connected together to an antenna array, which includes narrow and/or broadband elements, and multiple transmitters, receivers, or transceivers to allow for 360° transmission and/or reception. The antenna array system can provide multiple beams, such as without limitation 8 or 16 beams, which can vary in beam crossing and/or overlap to provide simultaneous up to 360° coverage.

In accordance with another embodiment, an antenna array system is provided, which includes a plurality of antenna elements configured in an array, a first Butler matrix operatively coupled to the plurality of antenna elements, and a second Butler matrix operatively coupled to the first Butler matrix.

The first Butler matrix may include a plurality of output ports and a plurality of input ports. Each of the plurality of output ports associated with the first Butler matrix may be operatively coupled to each of the plurality of antenna elements, and each of the plurality of input ports associated with the first Butler matrix may be coupled to each of a plurality of output ports associated with the second Butler matrix. The second Butler matrix may include a plurality of output ports and a plurality of input ports. Each of the plurality of output ports associated with the second Butler matrix may be operatively coupled to each of a plurality of input ports associated with the first Butler matrix, and each of the plurality of input ports associated with the second Butler matrix may be coupled to a transceiver. The antenna array system may include a switch, which can have one or multiple outputs and inputs. The second Butler matrix may include a plurality of output ports and a plurality of input ports. Each of the plurality of output ports associated with the second Butler matrix may be operatively coupled to each of a plurality of input ports associated with the first Butler matrix, each of the plurality of input ports associated with the second Butler matrix may be coupled to the output of the switch, and the input of switch may be coupled to a transceiver. The plurality of antenna elements may be configured to provide 360° coverage in response to the switch being swept through a plurality of positions. At least one of the plurality of antenna elements may include at least one of a bow tie antenna, log periodic antenna, and Vivaldi antenna.

The plurality of antenna elements may be configured as at least one of a circle, semi-circle, arc, line, sphere, and any conformal shape.

In accordance with another embodiment, a method of providing simultaneous 360° coverage is provided, which includes configuring a plurality of antenna elements in an array, coupling a first Butler matrix operatively to the plurality of antenna elements, and coupling a second Butler matrix operatively to the first Butler matrix.

The method may also include coupling each of a plurality of output ports associated with the first Butler matrix operatively to each of the plurality of antenna elements, and coupling each of a plurality of input ports associated with the first Butler matrix to each of a plurality of output ports associated with the second Butler matrix. The method may include coupling each of a plurality of output ports associated with the second Butler matrix operatively to each of a plurality of input ports associated with the first Butler matrix, and coupling each of a plurality of input ports associated with the second Butler matrix to a transceiver. The method may include coupling each of a plurality of output ports associated with the second Butler matrix operatively to each of a plurality of input ports associated with the first Butler matrix, coupling each of a plurality of input ports associated with the second Butler matrix to the output of a switch, and coupling the input of switch operatively to a transceiver. The method may include configuring the plurality of antenna elements to provide 360° coverage in response to the switch being swept through a plurality of positions. At least one of the plurality of antenna elements may include at least one of a bow tie antenna, log periodic antenna, and Vivaldi antenna. The method, configuring the plurality of antenna elements as at least one of a circle, semi-circle, arc, line, sphere, and any conformal shape.

Other embodiments of the invention will become apparent from the following detailed description considered in conjunction with the accompanying drawings. It is to be understood, however, that the drawings are designed as an illustration only and not as a definition of the limits of any embodiments of the invention.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements, which are useful or necessary in a commercially feasible embodiment, are not shown in order to facilitate a less hindered view of the illustrated embodiments.

DETAILED DESCRIPTION

Embodiments disclosed herein replace variable phase shifters and fixed phase shifters with a Butler matrix beam forming network. Phase and/or amplitude tapering may be used in order to generate narrow beams with reduced sidelobes. The elements of the array may be omni and/or directional radiators that are broad and/or narrow band configurations.

Figure 1:
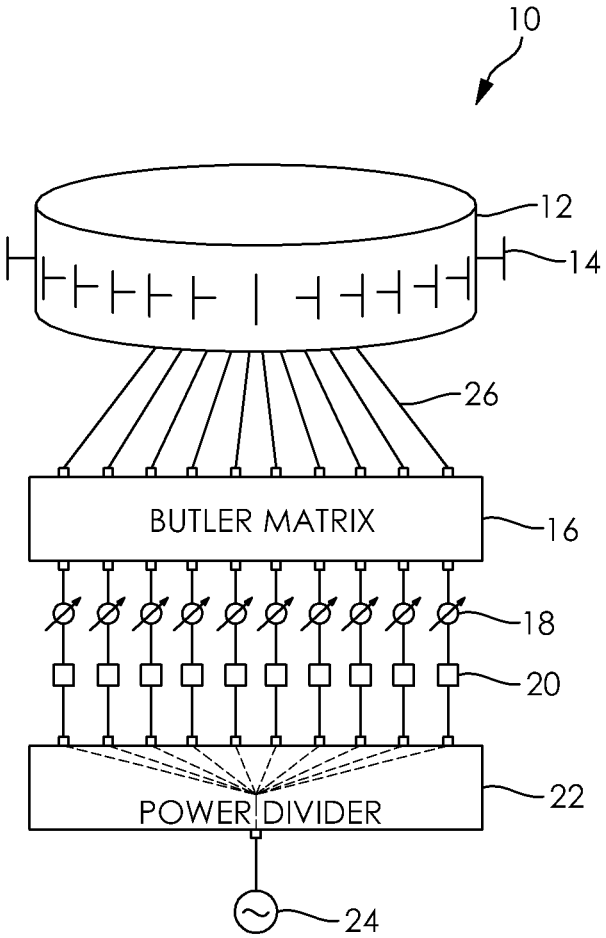
FIG. 1 shows a matrix fed circular array for continuous scanning.

FIG. 1 shows a matrix fed circular array 10 configured for continuous scanning. The matrix fed circular antenna array 10 includes a circular antenna array 12, which further includes a plurality of antenna elements 14, a Butler matrix 16, variable phase shifters 18, fixed phase shifters 20, and a power divider 22. The circular array 12 is coupled to output ports of the Butler matrix 16 by lines 26 of equal length. Each input port of the Butler matrix 16 is coupled to an output port of the power divider 22 through a variable phase shifter 18 and a fixed phase shifter 20. The power divider 22 is coupled to a transceiver 24.

Figure 2:
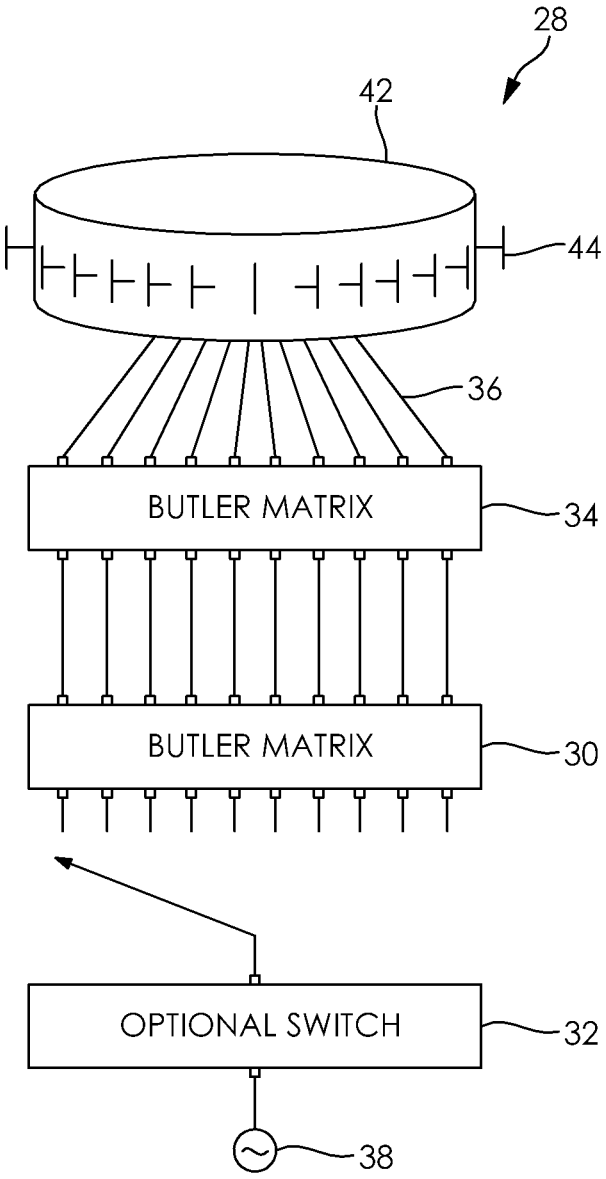
FIG. 2 shows an embodiment of a circular antenna array, in which variable and fixed phase shifters shown in FIG. 1 have been replaced with a Butler matrix.

FIG. 2 shows a first embodiment 28, which includes a circular array 42, a plurality of antenna elements 44, a first Butler matrix 34, a second Butler matrix 30, and an optional switch 32. The switch 32 can be an analog or a digital switch that selectively directs one or more signals to produce a beam in a certain location of 360° depending on which input of the Butler matrix is chosen. By sweeping through the positions of the switch 32, the beam can be swept to cover a 360° footprint.

Each of the antenna elements 44 in the circular array 42 is coupled to an output port of the first Butler matrix 34 by lines 36 of equal length. Each input port of the first Butler matrix 34 is coupled to an output port of the second Butler matrix 30. The second Butler matrix 30 effectively replaces the variable phase shifters 18 and fixed phase shifters 20 shown in FIG. 1. The optional switch 32 selectively couples input ports of the second Butler matrix 30 to a transceiver 38, and allows a user to switch through each beam to achieve simultaneous or sequential 360° coverage. For example, if the switch 32 applies the signal from the transceiver 38 to each of the inputs of the second Butler matrix, simultaneous 360° coverage is achieved. In addition, if the switch 32 sequentially applies the signal from the transceiver 38 to each of the inputs of the second Butler matrix, sequential 360° coverage is achieved. Further, if the switch 32 applies the signal from the transceiver 38 to less than all of the inputs of the second Butler matrix, partial coverage is achieved. The use of two Butler matrices 30, 34 enables antenna transmissions to cover 360° simultaneously, which cannot be performed using conventional antenna systems.

Figure 3:
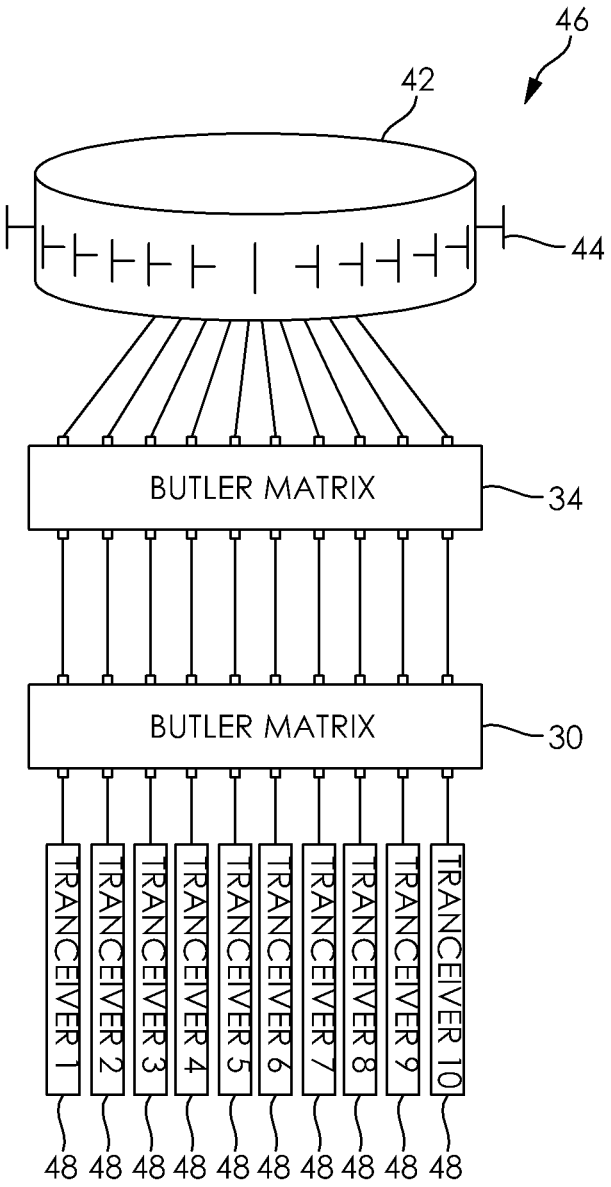
FIG. 3 shows another embodiment of a circular antenna array, in which variable and fixed phase shifters shown in FIG. 1 have been replaced with a Butler matrix.

FIG. 3 shows a second embodiment having ten (10) input ports to the second Butler matrix 30. If the Butler matrix 30 is configured correctly, an antenna beam is provided every 36°, that is, at 0°, 36°, 72°, etc. If each of the input ports of the second Butler matrix 30 is connected to a transceiver 48, as shown in FIG. 3, transmissions can occur simultaneously or sequentially at 360°. In contrast, conventional approaches, such as that shown in FIG. 1, include variable phase shifters 18 and fixed phase shifters 20 that can only sweep through an arc of a predetermined number of degrees in a manner that is similar to a clock's second hand that moves slowly around a central axis. However, this conventional approach provides discontinuous and non-simultaneous coverage over the predetermined arc. Since the variable phase shifters 18 and fixed phase shifters 20 require a certain amount of time to sweep through the predetermined arc, a potential target may be missed or may be allowed to pass through the predetermined arc without being detected due to latency in the phase shifters 18, 20. The second embodiment 46 shown in FIG. 3 enables connection of a multi-output transceiver 48 to couple each of the outputs of the second Butler matrix 30 to one or more transceivers 48 to provide 360° coverage.

Further, variable, fixed, and/or digital phase shifters are not as reliable as Butler matrices because the phase shifters are active and not passive. However, Butler matrices are passive and thus more robust and less likely to fail. In addition, Butler matrices can be made to cover a very broad band, which is larger than that of variable, fixed, and/or digital phase shifters.

Thus, the embodiments disclosed herein provide for random, simultaneous and/or sequential 360° antenna coverage without the necessity of scanning. Although 10 (input)×10 (output) Butler matrices are shown and described herein, it is to be understood that any configuration of Butler matrix, such as 8×8, 16×16, and the like may be used while remaining within the intended scope of the disclosure.

Figure 4:
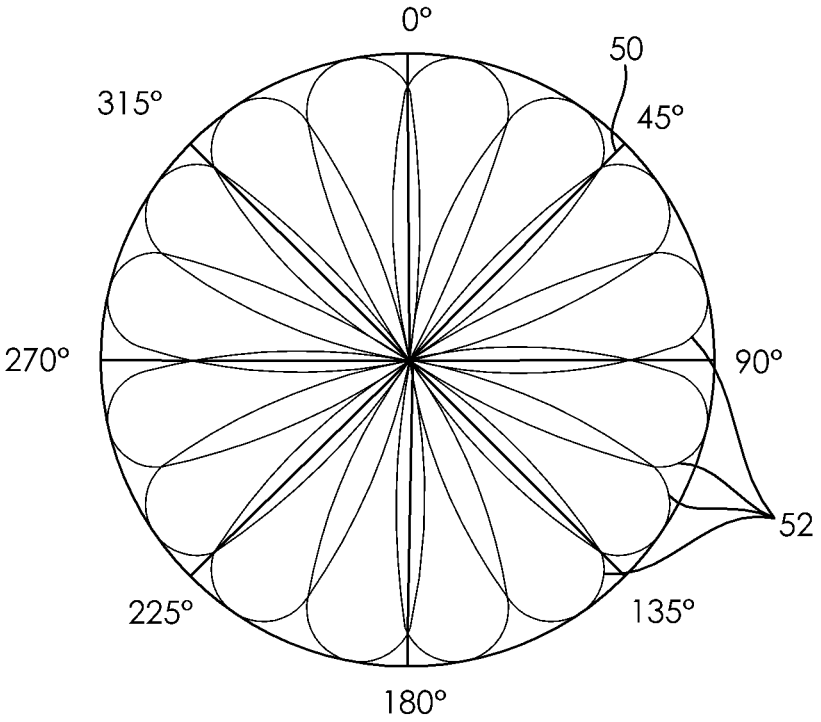
FIG. 4 shows an antenna beam pattern providing 360° coverage.

FIG. 4 shows an antenna beam pattern 50 with lobes 52 that shows an example of simultaneous 360° antenna coverage provided by the embodiment disclosed herein. In contrast, conventional approaches can only provide for an antenna pattern including fewer than each of the lobes 52, which are swept through a predetermined arc as function of time and cannot provide for 360° coverage at any given moment in time as shown in FIG. 4. Any combination of beams can be used to provide the 360° coverage, such as without limitation 2, 4, 6, 8, 24, and the like beams. The combination of beams depends on the construction and phase of the Butler matrices. The crossing and/or overlap between beams can also vary depending on the design of the Butler matrices.

Although the specification describes components and functions implemented in the embodiments with reference to particular standards and protocols, the embodiment are not limited to such standards and protocols. It is to be understood that the various references throughout this disclosure made to input and output ports are not intended as a limitation on the direction of energy passing through these ports since, by the Reciprocity Theorem, energy is able to pass in either direction. Rather these references are merely intended as a convenient method of referring to various portions of the disclosed embodiments.

The illustrations of embodiments described herein are intended to provide a general understanding of the structure of various embodiments, and are not intended to serve as a complete description of all the elements and features of apparatus and systems that might make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments of the inventive subject matter are referred to herein, individually and/or collectively, by the term "embodiment" merely for convenience and without intending to limit the scope of this application to any single embodiment or inventive concept. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. §1.72 (b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings of the invention provided herein, one of ordinary skill in the art will be able to contemplate other implementations and applications of the techniques of the invention. Although illustrative embodiments of the invention have been described herein with reference to the accompanying drawings, it is to be understood that the invention is not limited to those precise embodiments, and that various other changes and modifications are made therein by one skilled in the art without departing from the scope of the appended claims.

What is claimed is:

1. An antenna array system, which comprises:

a plurality of antenna elements, the plurality of antenna elements being configured in an array;

a first Butler matrix operatively coupled to the plurality of antenna elements;

a second Butler matrix directly coupled to the first Butler matrix without phase shifters coupled between the first Butler matrix and the second Butler matrix, the second Butler matrix replacing the phase shifters coupled between the first Butler matrix and the second Butler matrix, thereby increasing reliability and bandwidth associated with the antenna array system; and a 1:N switch, N being greater than one, the 1:N switch comprising a plurality of outputs and an input, the second Butler matrix comprising a plurality of first ports and a plurality of second ports, each of the plurality of first ports associated with the second Butler matrix being directly coupled to one of a plurality of third ports associated with the first Butler matrix using only a single, continuous line, the 1:N switch directly coupling each of the plurality of second ports associated with the second Butler matrix to a same, single signal from a single input/output port of a transceiver without phase shifters coupled between the 1:N switch and the plurality of second ports associated with the second Butler matrix and the 1:N switch being configured such that the 1:N switch applies the signal from the transceiver to each of the inputs of the second Butler matrix simultaneously, thereby enabling the antenna to provide 360° coverage.

2. The antenna array system, as defined by claim 1, wherein the first Butler matrix comprises a plurality of fourth ports and the plurality of third ports, each of the plurality of fourth ports associated with the first Butler matrix being operatively coupled to one of the plurality of antenna elements, each of the plurality of third ports associated with the first Butler matrix being coupled to one of the plurality of first ports associated with the second Butler matrix.

3. The antenna array system, as defined by claim 2, wherein each of the plurality of fourth ports associated with the first Butler matrix is operatively coupled to one of the plurality of antenna elements by a line having a length that is equal to the lengths of each of the other lines coupling the other fourth ports to the other antenna elements.

4. The antenna array system, as defined by claim 1, wherein at least one of the plurality of antenna elements comprises at least one of a bow tie antenna, log periodic antenna, and Vivaldi antenna.

5. The antenna array system, as defined by claim 1, wherein the plurality of antenna elements is configured as at least one of a circle, semi-circle, arc, line, sphere, and any conformal shape.

6. A method of providing simultaneous 360° coverage using a multi-beam antenna array, the method comprising:

configuring a plurality of antenna elements in an array;

coupling a first Butler matrix operatively to the plurality of antenna elements;

coupling a second Butler matrix directly to the first Butler matrix without phase shifters coupled between the first Butler matrix and the second Butler matrix, the second Butler matrix replacing the phase shifters coupled between the first Butler matrix and the second Butler matrix, thereby increasing reliability and bandwidth associated with the multi-beam antenna array;

coupling each of a plurality of first ports associated with the second Butler matrix directly to one of a plurality of third ports associated with the first Butler matrix using only a single, continuous line; and coupling directly each of a plurality of second ports associated with the second Butler matrix to a same, single signal from a single input/output of a transceiver using a 1:N switch without phase shifters coupled between the 1:N switch and the plurality of second ports associated with the second Butler matrix by configuring the 1:N switch such that the 1:N switch applies the signal from the transceiver to each of the inputs of the second Butler matrix simultaneously thereby enabling the antenna to provide 360° coverage, N being greater than one.

7. The method, as defined by claim 6, further comprising:

coupling each of a plurality of fourth ports associated with the first Butler matrix operatively to one of the plurality of antenna elements; and coupling each of the plurality of third ports associated with the first Butler matrix to one of the plurality of first ports associated with the second Butler matrix.

8. The method, as defined by claim 6, wherein at least one of the plurality of antenna elements comprises at least one of a bow tie antenna, log periodic antenna, and Vivaldi antenna.

9. The method, as defined by claim 6, further comprising configuring the plurality of antenna elements as at least one of a circle, semi-circle, arc, line, sphere, and any conformal shape.

* * * * *